United States Patent [19]

Garbe

[11] 3,967,451

[45] July 6, 1976

[54] STORAGE FACILITY WITH INTEGRAL FOUNDATION

[75] Inventor: Carl W. Garbe, San Carlos, Calif.

[73] Assignee: Dames & Moore, San Francisco, Calif.

[22] Filed: Sept. 11, 1974

[21] Appl. No.: 505,184

[52] U.S. Cl. ..... 61/.5; 61/34

[51] Int. Cl.[2] ..... B65G 5/00

[58] Field of Search ..... 61/.5, 39, 50, 59, 34

[56] References Cited

UNITED STATES PATENTS

| | | | |
|---|---|---|---|
| 231,924 | 9/1880 | McKenzie | 61/.5 |
| 942,653 | 12/1909 | Louque | 61/59 |
| 974,023 | 10/1910 | Campbell | 61/34 |
| 1,001,963 | 8/1911 | Latham | 61/59 |
| 1,057,859 | 1/1913 | Libbey | 61/34 |
| 1,159,055 | 11/1915 | Lowe, Sr. | 61/.5 |
| 1,475,696 | 11/1923 | Gow | 61/50 |
| 1,636,610 | 7/1927 | McClure | 61/34 X |
| 1,665,462 | 4/1928 | Howard | 61/59 |
| 1,746,566 | 2/1930 | Tufts | 61/59 X |
| 2,468,265 | 4/1949 | Larquetoux | 61/50 |
| 3,047,184 | 7/1962 | Van Bergen et al. | 61/.5 |

*Primary Examiner*—Dennis L. Taylor
*Attorney, Agent, or Firm*—Townsend and Townsend

[57] ABSTRACT

A process of constructing a storage facility, such as a tank, and the resultant storage facility product having an integral foundation is disclosed. Piles having conjoining sides are driven into the earth along a storage facility perimeter and pressure grouted to form a watertight perimeter. The piles penetrate into the earth to a depth where either the percolation of any acquifier into the storage facility or the leakage of product from the storage facility can be prevented. After installation of the piles. Soil is thereafter excavated below the existent ground level from the interior of the closed pile perimeter to the storage facility depth. The excavated soil is placed in a preferably compacted embankment immediately exterior of the piles perimeter where it extends above the ambient ground level. This compacted embankment together with the subterranean portion of the pile perimeter is maintained in a closed fluid-tight relation by the soil pressure arching adjacent piles compressively together. During excavation, wales are placed against the storage facility sides. When the excavation reaches the full tank depth, the tank bottom is finished typically by a concrete rat slab. A conventional top is then provided.

12 Claims, 4 Drawing Figures

STORAGE FACILITY WITH INTEGRAL FOUNDATION

This invention relates to storage facilities. More specifically, this invention relates to a partially submerged storage facility such as a circular tank and a process for the construction of such a storage facility.

SUMMARY OF THE PRIOR ART

Storage facilities for holding liquid products, such as petroleum, have commonly heretofore consisted of steel tanks. Such steel tanks have static heads of product in them which, with increasing heights, require increasingly thick conventional steel sidewalls to resist the static heads of fluid pressure within the tank. Typically, the tanks, at their steel plate, resist pressure internally of the tank with tension. As the tank height increases, especially above the level of 72 feet, the plate necessary to provide the requisite tension at the bottom of the tank to counteract internal static heads of pressure has to be so thick that the tank often becomes uneconomical.

A further problem with existent steel storage facilities, such as tanks, is that such storage facilities have to be placed on conventional foundations. These storage facilities on conventional foundations with their interior heavy loads have been found to settle. Slight angular settlement of the tank presents structural difficulties and can result in tank failure. Moreover, where tanks are provided with a circular floating top, the respective sides of the tank become elliptical in horizontal section when differential settlement on a conventional foundation occurs. As the floating top remains circular, it can bind and therefore remain unable to rise upwardly and downwardly of the tank sidewalls as the level of product stored within the tank rises upwardly and downwardly.

Finally, it is noted that "farms" of storage facilities containing combustible or corrosive products are required world-wide to be subdivided with soid dikes. Each separate storage facility must contain a soil dike about it capable of containing the entire contents of the surrounded storage facility in the event that the storage facility is ruptured. This diking requirement uses much land, requires additional expense in the excavations required to make the dikes, and finally produces storage facility "tank farms" that become a double eyesore not only because of the presence of the discrete storage facilities or tanks themselves, but also because of the required dikes.

SUMMARY OF THE INVENTION

A process of constructing a storage facility, such as a tank, and the resultant storage facility product having an integral foundation is disclosed. Typically, piles having conjoining sides (preferably of the tongue and groove variety) are driven into the earth along a proposed storage facility perimeter and pressure grouted along their conjoined sides to form a watertight perimeter. The piles forming the closed pile perimeter penetrate into the earth a substantial portion of their length and preferably extend into impervious soil strata. This penetration into impervious soil strata occurs to a depth where either the percolation of any acquifier into the storage facility or the leakage of product from the storage facility can be prevented by ambient soil strata. After installation of the closed pile perimeter, soil is thereafter excavated below the existent ground level from the interior of the closed pile perimeter to the intended storage facility depth. The excavated soil is placed in a preferably compacted embankment immediately exterior of the closed pile perimeter where it extends above the ambient ground level. The compacted soil embankment forms a static head inwardly on the pile perimeter that exceeds anticipated static heads for the stored product within the storage facility. This compacted embankment together with the subterranean portion of the pile perimeter is maintained in a closed fluid-tight relation by the soil pressure arching adjacent piles compressively together. During excavation, wales are placed against the storage facility sides, preferably by casting the wales in place as excavation proceeds. When the excavation reaches the full tank depth, the tank bottom is finished typically by a concrete rat slab. A conventional top is then provided. The resultant finished storage facility utilizes pile sidewalls, has an integral foundation, and is held together with an earth dike to provide an inexpensive storage facility preferable for the storage of petroleum or other fluid products.

OTHER OBJECTS AND ADVANTAGES OF THE INVENTION

An object of this invention is to disclose a process for storage facility construction which utilizes concrete construction in lieu of steel construction. According to this aspect, a closed pile perimeter is first constructed. Upon excavation of the interior of the closed pile perimeter, the pile perimeter is compressed together and the interior storage volume is simultaneously defined.

An advantage of this invention is that pile sidewalls under compression are substituted for steel sidewalls under tension for resisting loading due to stored products within the facility. Concrete under compression can be substituted for steel under tension. Cost of the storage facility is vastly reduced.

A further advantage of this invention is to substitute modern foundation construction techniques for steel fabricated techniques in the construction of a storage facility, such as a tank.

A further object of this invention is to disclose piles for providing a closed pile perimeter suitable for forming the sides of a liquid product storage facility. According to this aspect, adjacent piles are provided with conjoining adjacent sides having mating tongues and grooves to form a closed pile perimeter. Additionally, the piles, when driven in the ground, are tapered so that each driven pile biases towards an adjacent previously installed pile.

An advantage of the piles utilized with this invention is that they are urged into a contiguous conjoinder in side-by-side relation when driven. The achieving of a side-by-side liquid impervious barrier between adjacent piles is facilitated.

A further object of this invention is to disclose a storage facility which uses underground soil pressure to hold it together. According to this aspect of the invention, a closed pile perimeter has its interior excavated. Soil pressure from the outside exceeds stored product pressure from the inside. The result is that the sidewalls of the storage facility, formed from contiguous and conjoined piles, is always under radial compression between adjacent piles to assure a fluid-tight storage facility perimeter.

A further advantage of this invention is that the natural inwart thrust of the ambient soil is utilized to hold the foundation of the storage facility in place.

A further object of this invention is to disclose an underground storage facility having an integral foundation. According to this aspect, the interior of a closed pile perimeter is excavated. The soil exterior of the excavation becomes the storage facility foundation.

An advantage of this integral foundation is that a conventional foundation for the storage facility is not required. Rather, the foundation perimeter and the storage facility perimeter are one in the same.

A further object of this invention is to construct integrally with a submerged storage facility, such as a petroleum storage tank, an integral soil dike. According to this aspect, portions of the closed pile perimeter are allowed to protruce upwardly and above the ambient ground level. Soil excavated from the interior of the pile perimeter is stacked around and about those portions of the soil perimeter extending above ambient ground level.

An advantage of this aspect of the invention is that the soil dike can be used to hold the tank together at elevations above ground level by compressing inwardly on the closed pile perimeter above ground level.

A further advantage is that the soil dike can simultaneously serve as an emergency barrier to contain product in the event that the pile perimeter is ruptured.

Yet a further advantage of this aspect of the invention is that the soil dike forms a convenient location immediate the excavated storage facility for the placement of soil from the interior of the storage facility.

Yet another advantage of this aspect of the invention is that adjacent storage facilities can be placed in closer relationship. The expanse of land used in forming a so-called "farm" of storage facilities can be vastly reduced.

Yet another advantage of this aspect of the invention is that the eyesore resulting from a storage facility "farm" is minimized. The bulk of the storage facility is subterranean. That portion of the storage facility above ground is embanked in soil, and capable of blending on an unobtrusive basis into the landscape.

Yet another advantage of the storage facility of this invention is that the resultant tank is virtually maintenance free. As the sidewalls of the tank are typically concrete and not metal, preservative techniques utilized in the maintenance of metal storage facilities need not be used to maintain storage facilities constructed in accordance with this invention.

Other objects, features and advantages of this invention will become more apparent after referring to the following specification and attached drawings in which.

Figure 1:
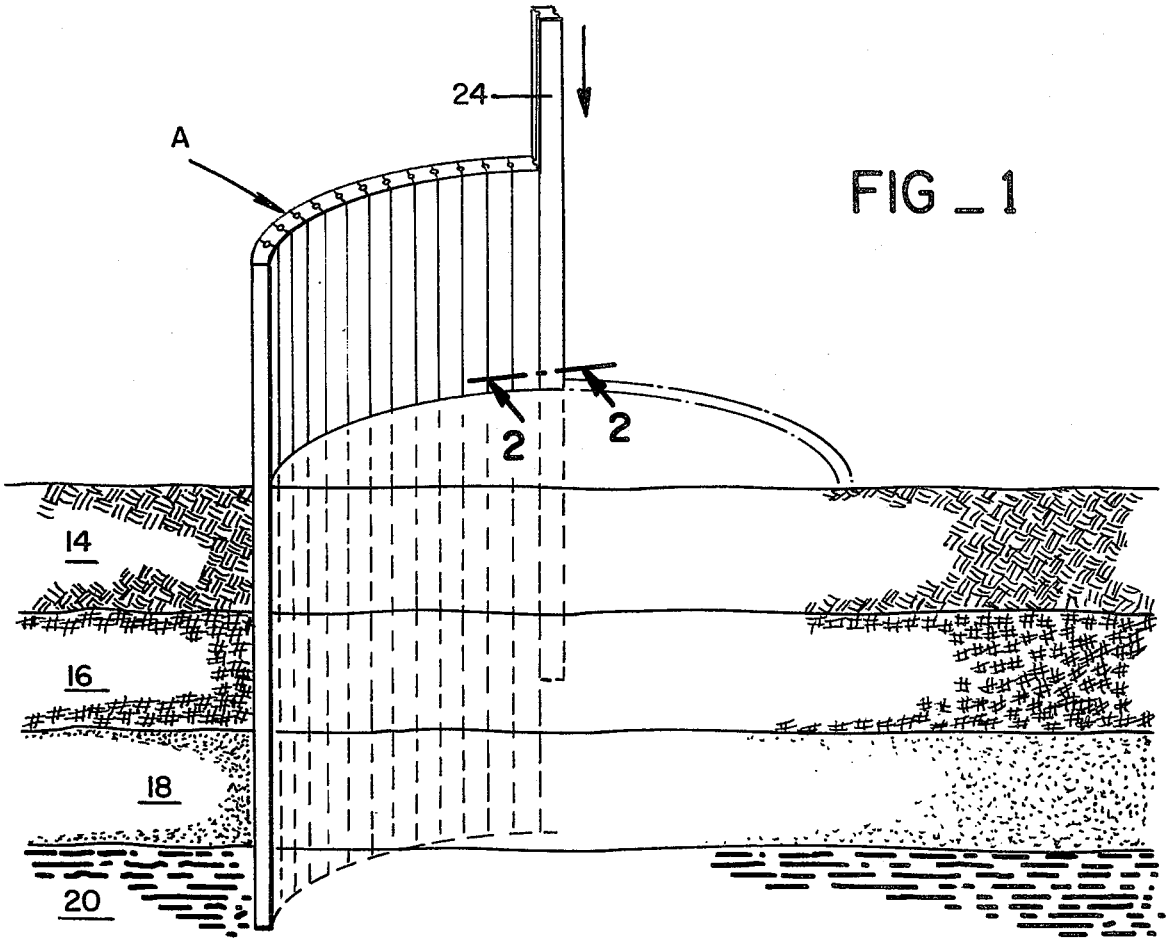
FIG. 1 is a vertical section of soil strata taken through the ground illustrating in phantom the partial installation of a closed pile perimeter with a series of piles installed and one pile being driven to form the closed pile perimeter.
Figure 3:
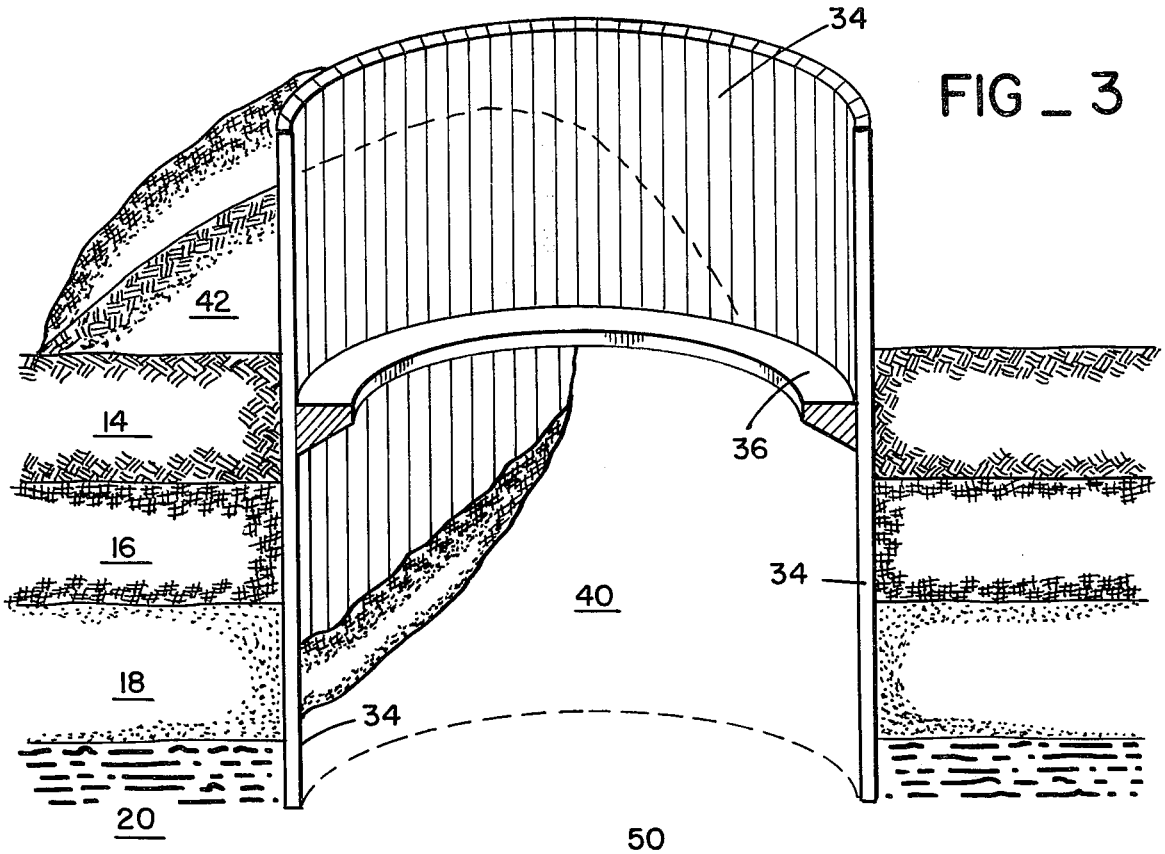
Figure 4:
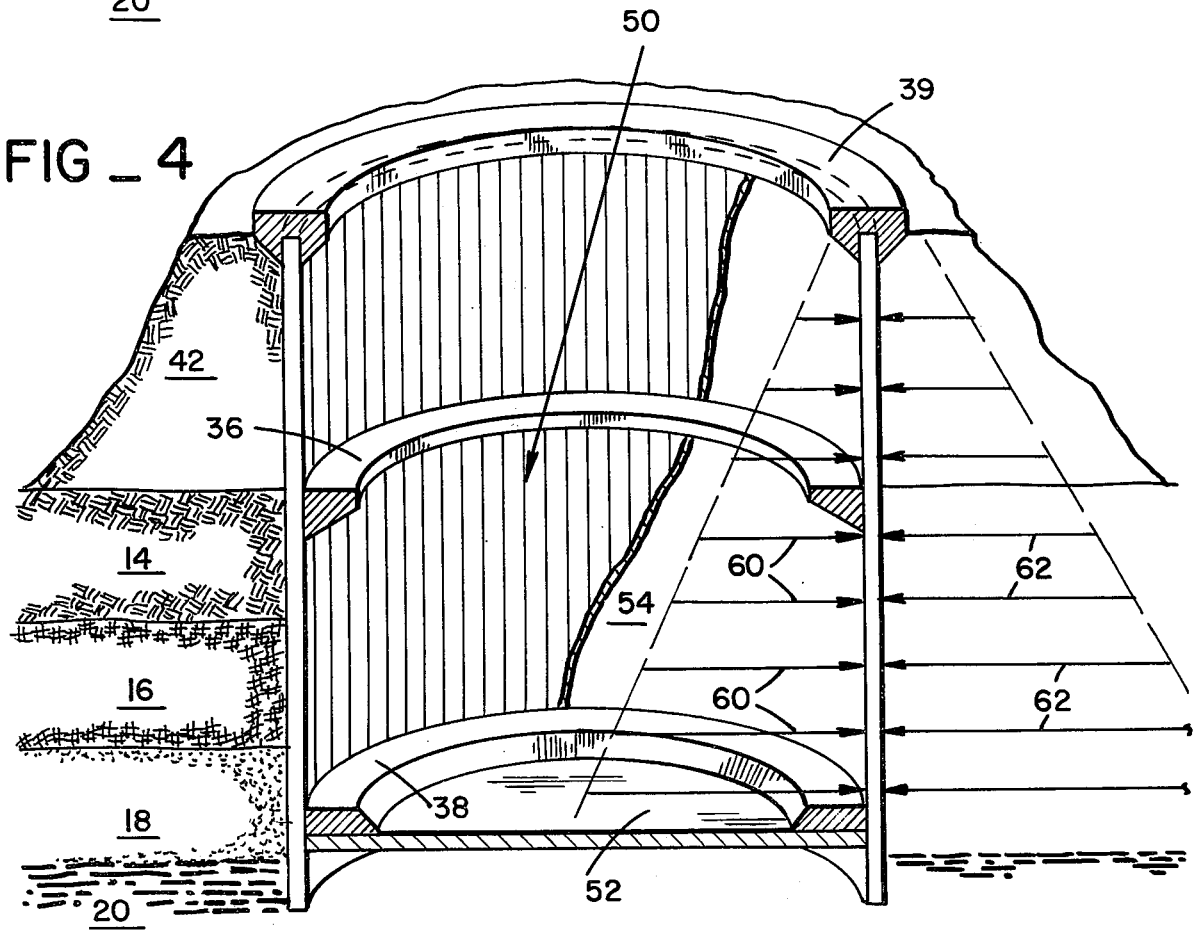

FIG. 3 is a perspective vertical section similar to FIG. 1 illustrating the placement of a ground level concrete wale around the interior of closed pile perimeter with excavation occurring interior of the storage facility, and the excavation spoils being stacked and compacted exterior of the storage facility to form a dike about the upper portion of the storage facility; and, FIG. 4 is a cross sectional configuration of the storage facility similar to FIG. 1 with the storage facility constructed to its full depth, the respective cast-in-place concrete wales reinforcing the storage facility sidewalls, a finished rat slab poured on the bottom of the storage facility, and the side of the storage facility finished in concrete "gunite" construction.

Referring to FIG. 1, a vertical cross section is shown taken through a typical site for the installation of the storage facility. Various soil strata, typically of the sedimentary type, are illustrated in strata 14, 16, 18 and 20. It is preferable that the storage facility be installed to penetrate to an impermeable soil strata, here indicated as stratum 20.

A closed pile perimeter A is formed about the boundary of the storage facility. PErimeter A includes a series of discrete piles 24 driven in conjoined and contiguous side-by-side relation. These piles, as hereinafter will be more fully set forth, constitute the sidewalls of the storage facility.

Figure 2:
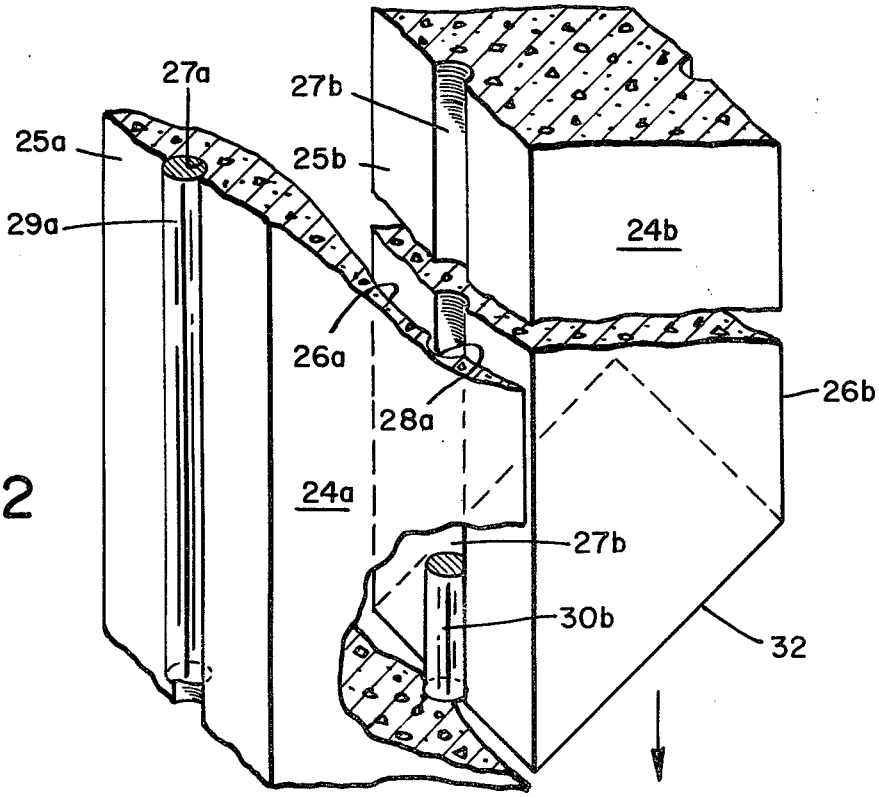
FIG. 2 is an enlarged vertical section in perspective taken along lines 2—2 of FIG. 1 vertically broken away, illustrating the pile being driven alongside of a previously installed pile and showing the conjoinder of the piles at adjacent tongue and groove section.

Referring to FIG. 2, the installation of adjacent piles **24*a* and 24*b* is illustrated. To understand the adjacent installation of the piles 24*a* and 24*b***, the configuration of the piles will first be discussed. Thereafter, the process of their installation can be easily set forth.

Pile **24*a* is typical. Preferably, each pile is made from pre-cast concrete having a compressive strength of the concrete on the order of 8000 psi. The piles are preferably prestressed. Pile 24*a*** is installed to a predetermined depth. This installation occurs by typical pile installation techniques such as pile drivers using conventional leads and the like.

Pile **24*a* at side 25*a* includes a groove 27*a* which is semicircular in shape. Groove 27*a* extends along side 25*a* to the bottom of pile 24*a*. This groove enables conjoinder of one pile to an immediately adjacent pile and further permits pressure grouting of the two piles along their adjoined sides to assure a fluid-tight interface between the two piles. This conjoinder, by pressure grouting, forms a grout cylinder 29*a*** which will hereinafter be discussed.

Pile **24*a* includes a second side 26*a*. Side 26*a* includes a groove 28*a*. Groove 28*a* is semicircular in section and extends along the entire side 26*a* from the top of the pile 24*a* to the bottom of pile 24*a***.

The bottom of pile **24*a* includes two features. It includes a tapered end which can be driven into the ground and a short tongue. These features can best be observed at the bottom of pile 24*b*, which bottom is identical to the bottom of pile 24*a*** (not shown).

Referring to pile **24*b* of FIG. 2, the lower end of semicircular groove 27*b* can be observed. This groove terminates at a tongue 30*b*. Tongue 30*b* is semicircular in shape and made to ride interiorly of groove 28*a* of pile 24*a***.

The tapered end 32 of pile **24*b* can be observed. This end tapers from side 25*b* of pile 24*b* to side 26*b*. This taper assures that pile 24*b*, when driven, is biased towards pile 24*a***.

The installation of the conjoining piles can now easily be explained. With at least one pile **24*a* installed, a pile 24*b* is moved into juxtaposition to pile 24*a* with side 25*b* of pile 24*b* confronted to side 26*a* of pile 24*a*. Tongue 30*b* of pile 24*b* is placed interiorly of groove 28*a* of pile 24*a*. Thereafter, pile 24*b* is conventionally driven downwardly into the ground in precise side-by-side juxtaposition to pile 24***a*. During this driving, tapered end 32 of pile 24*b* urges pile 24*b* towards pile 24*a* to closely confront side 26*a* of pile 24*a* with side 25*b* of pile 24*b*.

When pile 24*b* has been fully driven into the ground, it will be seen that the two grooves 28*a* of pile 24*a*, and 27*b* of pile 24*b* will confront one another. The two semicircular section grooves 28*a* and 27*b* will define a cylindrical volume. This volume is first drilled clean to remove earth and the like. Thereafter, grout is forced into the groove preferably by a tremie installation to provide a fluid-tight seal between adjacent piles. This process is commonly referred to as "pressure grouting" and forms a grout cylinder similar to grout cylinder 29*a*.

It should be realized that the process of installing adjacent piles, drilling clean the cylindrical volume defined between the piles, and pressure grouting the cylindrical volumes between them can occur at different portions of the pile perimeter at different times. For example, all of the piles could first be driven in place. Thereafter, all of the piles could have their respective confronting grooves drilled, and finally all of the piles could be pressure grouted. Alternately, the sequence of driving the piles, drilling the holes, and pressure grouting the holes can be varied to conform to the efficiencies of construction. Typically, the piles will be driven to form a circular or elliptical continuous and closed pile perimeter. Referring to the views of FIGS. 3 and 4, a circular perimeter is illustrated. It will be immediately realized that only one half of the circular perimeter is there shown. The remaining half is omitted so that the internal construction of the storage facility can be more easily illustrated.

Referring to FIG. 3, the remaining steps of construction of the storage facility together with the finished product can be understood.

First, a concrete wale 36 is typically cast in place at ground level about the interior of the closed pile perimeter. As will hereinafter be more fully understood, when the storage facility is empty, ambient earth from the outside will tend to push inwardly towards the inside. In the event of non-uniform pressures against the perimeter wall, collapse of the pile perimeter could occur. Wale 36 serves to resist such collapse.

It should be further appreciated that although wale 36 is preferably herein described as being cast in place, it could just as well be pre-cast and later installed at the site. Likewise, such a wale could be used as a guide placed in the ground first. Thereafter the pile perimeter could be driven around it as heretofore described.

Once wale 36 has been cast in place, excavation of the volume 40 interior of the storage facility occurs. Earth spoils from the interior of the storage facility are embanked in a compacted embankment 42 above the ambient ground level and on the outside of closed pile perimeter 34. Thus, it is seen that excavation spoils are moved a relatively short distance. They are moved from the subterranean volume of the storage facility to the immediately adjacent and above ground outside perimeter of the closed pile perimeter 34.

Referring to FIG. 4, a cross section of the completed underground storage facility according to this invention is illustrated. The interior volume 50 of the storage facility has been completely excavated. A compacted soil embankment 42 has been placed peripherally about that portion of the closed pile perimeter 34 which extends above the ambient ground level. A bottom wale 38 has been cast around the bottom portion of excavated volume 50. This bottom wale prevents the closed pile perimeter 34 from collapsing inwardly. Likewise, an upper wale 39 has been poured over the topmost portion of closed pile perimeter 34. Upper wale 39 caps the pile perimeter and at the same time prevents the pile perimeter 34 at the top from collapsing inwardly.

Preferably, the wales 36, 38 and 39 are sized to permit radial compression of the closed pile perimeter. Thus, the ambient forces of the earth loading exteriorly of the pile perimeter 34 radially compresses the piles along their conjoined sides into close and contiguous side-by-side relation. A fluid-tight storage facility perimeter results.

The tank is finished at the bottom by rat slab 52. Dependent upon soil conditions, a thicker mat could be used. Likewise, along the tank side a gunite concrete finish 54 or thin sheet metal finish can be applied.

Upon completion of the storage facility, a top can be added. Preferably, the top used with this type of tank is a conventional fixed top to completely enclose the storage facility. It should be understood, however, that floating tops and the like can be used.

It should be understood that soil pressure from the storage facility exterior is always designed to be greater than product pressure from the tank interior. This effect is schematically illustrated by graphs 60, 62. Consequently, radial compression of closed pile perimeter 34 will always be present to maintain a fluid-tight perimeter.

I claim:

1. A process of constructing a storage facility interiorly of the ground below ground level for storing liquid products comprising the steps of: driving piles into the earth around the storage facility perimeter to form a substantially circular closed pile perimeter around a first diameter; said piles penetrating into the earth and extending above the earth a preselected distance in contiguous side-by-side relation to form said closed perimeter; after forming said closed pile perimeter, excavating below existent ground level interiorly of said closed pile perimeter to said intended storage facility depth to cause soil pressure from the exterior of said pile perimeter toward the interior of said pile perimeter to urge said piles into continguous side-by-side relation; before and during said excavating step placing at least one substantially circular wale extending horizontally at an elevation between the top of said facility and the bottom of said facility having a second outside diameter less than said first diameter whereby said piles are urged into contiguous side-by-side relation by soil pressure from the exterior of said piles toward the interior of said pile perimeter; placing said excavated spoils immediately exterior of said closed pile perimeter on said ground; and, compacting said excavation spoils to form about that portion of the closed pile perimeter above the earth an embankment having an inward force on said closed pile perimeter having a static force on the exterior of said closed pile perimeter in excess of the static pressure from said liquid product on the interior of said closed perimeter.

2. The process of claim 1 including the additional step of providing a slab at the bottom of said excavation to close the bottom of said storage facility.

3. The process of claim 1 and including the step of finishing the interior of said closed pile perimeter.

4. The invention of claim 1 and wherein said driven piles are of reinforced precast concrete.

5. The process of claim 1 and wherein said driving step includes providing piles having grooves along their conjoined sides; providing at the bottom of one of said piles a tongue for passage into the groove of an adjacent pile; driving said pile with said tongue conjoining an adjacent pile at said groove; drilling said groove; and, pressure grouting said groove.

6. A storage facility having an integral foundation comprising: a series of piles driven inwardly into the ground at least a substantial portion of their length in contiguous side-by-side relation to form a substantially circular closed perimeter of a first diameter; said piles as forming said substantially circular closed pile perimeter having a first portion extending downwardly and into the ground, and a second portion extending upwardly and above the ground; the earth interior of said closed pile perimeter excavated to the full storage facility depth; at least one substantially circular wale of a second diameter less than said first diameter whereby said piles are urged into a contiguous side-by-side relation by soil pressure from the exterior of said pile perimeter into the interior of said pile perimeter; a compacted embankment placed above the ground and immediately about that portion of said closed pile perimeter extending above said ground having a static force on the exterior of said closed pile perimeter; and a liquid stored within said excavated and closed pile perimeter having a static pressure from the interior of said pile perimeter to the exterior of said pile perimeter less than the ambient static soil pressure load from the exterior of said pile perimeter toward the interior of said pile perimeter whereby said exterior soil load holds said pile perimeter in contiguous side-by-side relation at all liquid loadings of said facility.

7. The invention of claim 6 and including a slab at the bottom of said storage facility for closing the bottom of said storage facility.

8. The invention of claim 6 and wherein said piles have a finished surface interiorly of said excavated storage facility.

9. The process of claim 1 and wherein said pile perimeter is elliptical.

10. The invention of claim 6 and wherein said pile perimeter is elliptical.

11. A process of constructing a storage facility interior the ground below ground level for storing liquid products comprising the steps of: providing piles having grooves along their conjoined sides; providing at the bottom of one of said piles a tongue for passage into the groove of an adjacent pile; driving said pile with said tongue conjoining an adjacent pile at said groove; cleaning the groove between adjacent piles; pressure grouting said groove; driving a series of said piles into the earth around the storage facility perimeter to form a substantially circular closed pile perimeter around a first diameter; said piles penetrating into the earth and extending above the earth a preselected distance in contiguous side-by-side relation to form said closed pile perimeter; after forming said closed pile perimeter, excavating below existing ground level interior of said closed pile perimeter to said intended storage facility depth to cause soil pressure from the exterior of said pile perimeter toward the interior of said pile perimeter to urge said piles into contiguous side-by-side relation; before enduring said excavation step placing at least one substantially circular wale extending horizontally at an elevation between the top of said facility and the bottom of said facility having a second outside diameter less than the first diameter whereby said piles are urged into contiguous side-by-side relation by soil pressure from the exterior of said piles to the interior of said pile perimeters; placing said excavating spoils immediately exterior of said closed pile perimeter on said ground; compacting said excavation spoils to form about a portion of the closed pile perimeter above the earth an embankment having an inward force on said closed pile perimeter having a static force on the exterior of said closed pile perimeter in excess of static pressure from said liquid product on the interior of said closed pile perimeter.

12. The invention of claim 11 and wherein said drilling of said groove and said pressure grouting of said groove occurs for said excavation step.

* * * * *